US005321918A

United States Patent [19]

Brian

[11] Patent Number: 5,321,918

[45] Date of Patent: Jun. 21, 1994

[54] SPINDLE GRINDING METHOD AND APPARATUS

[76] Inventor: Frank J. Brian, 3701 Ahern St., Baldwin Park, Calif. 91706

[21] Appl. No.: 989,712

[22] Filed: Dec. 14, 1992

[51] Int. Cl.[5] ..... B24B 1/00; B24B 5/06

[52] U.S. Cl. ..... 51/290; 51/281 P; 51/100 R; 51/105 R; 51/131.1

[58] Field of Search ..... 51/290, 281 P, 241 S, 51/241 VS, 34 R, 34 C, 37, 48 R, 50 R, 165.93, 165.75, 100 R, 105 R, 131.1, 165.77

[56] References Cited

U.S. PATENT DOCUMENTS

| | | | |
|---|---|---|---|
| 810,903 | 1/1906 | Blechschmidt | 51/34 C |
| 998,508 | 7/1911 | Hattersley et al. | 51/50 R |
| 1,559,245 | 10/1925 | Gilbert . | |
| 1,580,379 | 4/1926 | Locken . | |
| 1,662,137 | 3/1928 | Summers . | |
| 1,729,288 | 9/1929 | Harrell . | |
| 1,756,014 | 4/1930 | Streby | 51/50 R |
| 1,991,834 | 2/1935 | Albertson . | |
| 2,442,683 | 6/1948 | Green | 51/50 R |
| 2,470,221 | 5/1949 | Mott . | |
| 2,720,736 | 10/1955 | McAfee | 51/241 VS |
| 2,738,627 | 3/1956 | Blagg . | |
| 3,022,608 | 1/1960 | Tree . | |
| 3,071,902 | 1/1963 | Curfman | 51/241 VS |
| 3,613,320 | 10/1971 | Mighton | 51/290 |
| 4,646,476 | 3/1987 | Yui | 51/166 TS |

FOREIGN PATENT DOCUMENTS

| | | | |
|---|---|---|---|
| 204958 | 12/1986 | European Pat. Off. | 51/241 VS |
| 1246151 | 10/1960 | France | 51/165.75 |

*Primary Examiner*—Jack Lavinder
*Attorney, Agent, or Firm*—William W. Haefliger

[57] ABSTRACT

The method of grinding the tapered bore of a rotary spindle, to true the bore while the spindle rotates about a spindle axis, the steps that include providing structure including a master plate having a surface facing the bore, the surface having a predetermined boundary to define a center; providing an angled slide on the structure, the slide being movable endwise relative to the structure and at a predetermined angle to the spindle axis, the angle corresponding to the spindle bore taper; providing a rotary grinder on the angled slide to be movable endwise therewith while the grinder rotates; adjusting the structure to bring the master plate surface into perpendicularity to the axis and to bring the center into coincidence with the axis, and; operating the grinder to grind the tapered bore as the spindle is rotated and as the angled slide is moved endwise.

4 Claims, 2 Drawing Sheets

SPINDLE GRINDING METHOD AND APPARATUS

BACKGROUND OF THE INVENTION

This invention relates generally to truing the bores of rotary spindles, and more particularly concerns method and apparatus for effecting said truing by grinding the spindle bore while the spindle itself is rotating.

There are many advantages to grinding a spindle in place, one being the low down time. If the spindle were to be removed, more than likely the bearings and seals would, or at least should, be replaced. This becomes a procurement problem. Some seals and bearings can be long lead time procurement items. The spindle then needs to be sent out for grinding. This is also time consuming. All of this processing requires highly trained personnel, because in reassembly bearing preload and alignment is important.

There is another advantage to grinding in place, having to do with negating the run-out inherent in the bearings. By grinding in place, all items are taken into consideration and trued up.

Accordingly, there is need for improved method and apparatus to enable grinding of a machine tool spindle in place, i.e., without removing it from the machine.

SUMMARY OF THE INVENTION

Basically, the method of the invention comprises:

a) providing structure including a master plate having a surface facing the bore, the surface having a predetermined boundary to define a center, b) providing an angled slide on the structure, the slide being movable endwise relative to the structure and at a predetermined angle to the spindle axis, the angle corresponding to the spindle bore taper, c) providing a rotary grinder on the angled slide to be movable endwise therewith while the grinder rotates, d) adjusting the structure to bring the master plate surface into perpendicularity to the axis and to bring its center into coincidence with that axis, and e) operating the grinder to grind the tapered bore as the spindle is rotated and as the angled slide is moved endwise.

Typically, the structure includes a bottom slide to be movable generally normal to the spindle axis, the master plate mounted on the bottom slide to be movable therewith. Also, the master plate is typically provided with a boundary or edge extending about the master plate surface, that boundary used to center the master plate relative to the spindle axis. Accordingly, a relationship is established between the master plate, the bottom slide, and the angled slide, to provide a reference locating for the grinder relative to the spindle tapered bore to be ground in place.

More specifically, the spindle grinder is set up using the master plate which establishes an X-Y plane perpendicular to the center line established by the rotation of the shaft in the spindle bearings. After the X-Y plane perpendicularity is established, the outside circumference of the master plate is swept to provide concentricity to the center line of spindle rotation. With concentricity established, the angled slide can be moved in and out to grind the spindle.

The grinder is always working on a radian which passes through center; therefore, the X-Y plane relationship is always intact.

A further object involves providing the boundary of the master plate to extend circularly about the master plate surface, and employing a sensor to engage the circular boundary during the d) step.

Further objects include providing a motor drive for the rotary grinder to rotate same, and supporting the motor on the bottom slide; and moving a rotary grinding head defined by the grinder along a slant height defined by the rotary tapered bore of the spindle rotating in place to accomplish truing.

Apparatus for grinding the spindle bore basically comprises:

a) structure including a master plate having a surface facing the bore, the surface having a predetermined boundary (for example a circular edge) to define a center, b) an angled slide on the structure, the slide being movable endwise relative to the structure and at a predetermined relative angle to the spindle axis, the angle corresponding to the spindle bore taper, c) a rotary grinder on the angled slide to be movable endwise therewith while the grinder rotates, d) the structure being adjustable to bring the master plate surface into perpendicularity to the axis and to bring its center into coincidence with that axis, e) whereby the grinder may be operated to grind the tapered bore as the spindle is rotated and as the angled slide is moved endwise.

These and other objects and advantages of the invention, as well as the details of an illustrative embodiment, will be more fully understood from the following specification and drawings, in which:

DRAWING DESCRIPTION

DETAILED DESCRIPTION

Figure 1:
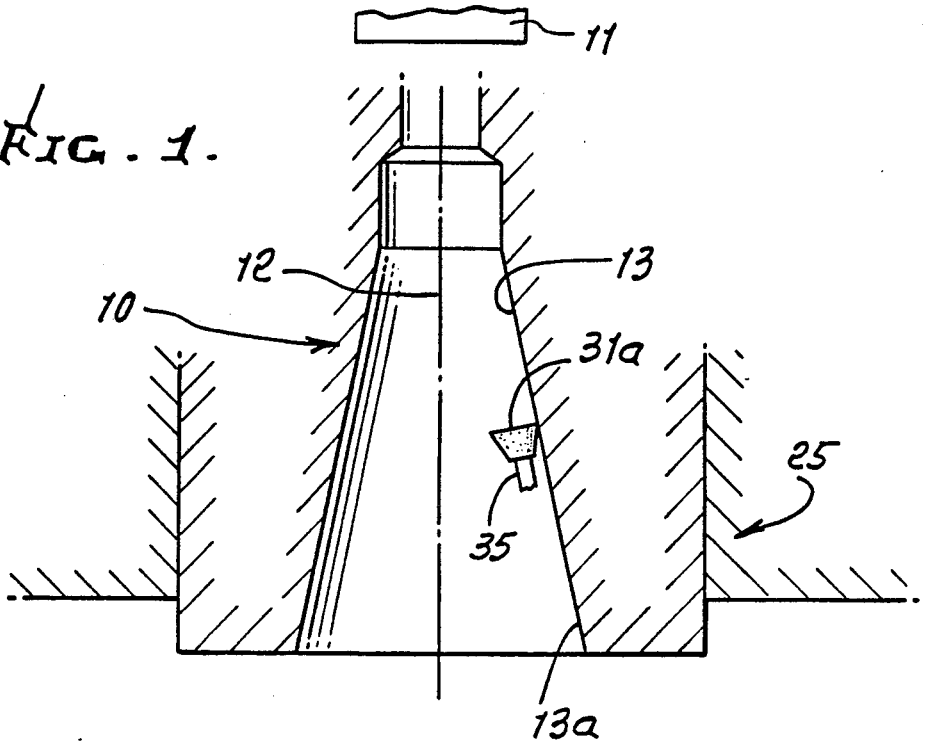
FIG. 1 is a section taken through a spindle, the bore of which is to be ground in place.

In the drawings, a rotary spindle 10 is rotatable by means generally indicated at 11, to rotate about an axis 12. The spindle is typically used during machining, such as milling, and may receive the shaft of a milling tool, the shaft engaging the spindle tapered bore 13. The latter typically becomes larger at its larger end 13*a* in use, due to wear. Also, chips and other foreign material may become trapped at the taper and cause deformation and taper deterioration. This can lead to decreased tool life, excess vibration, out of tolerance condition of the work to be machined, and poor finish of the latter.

Figure 2:
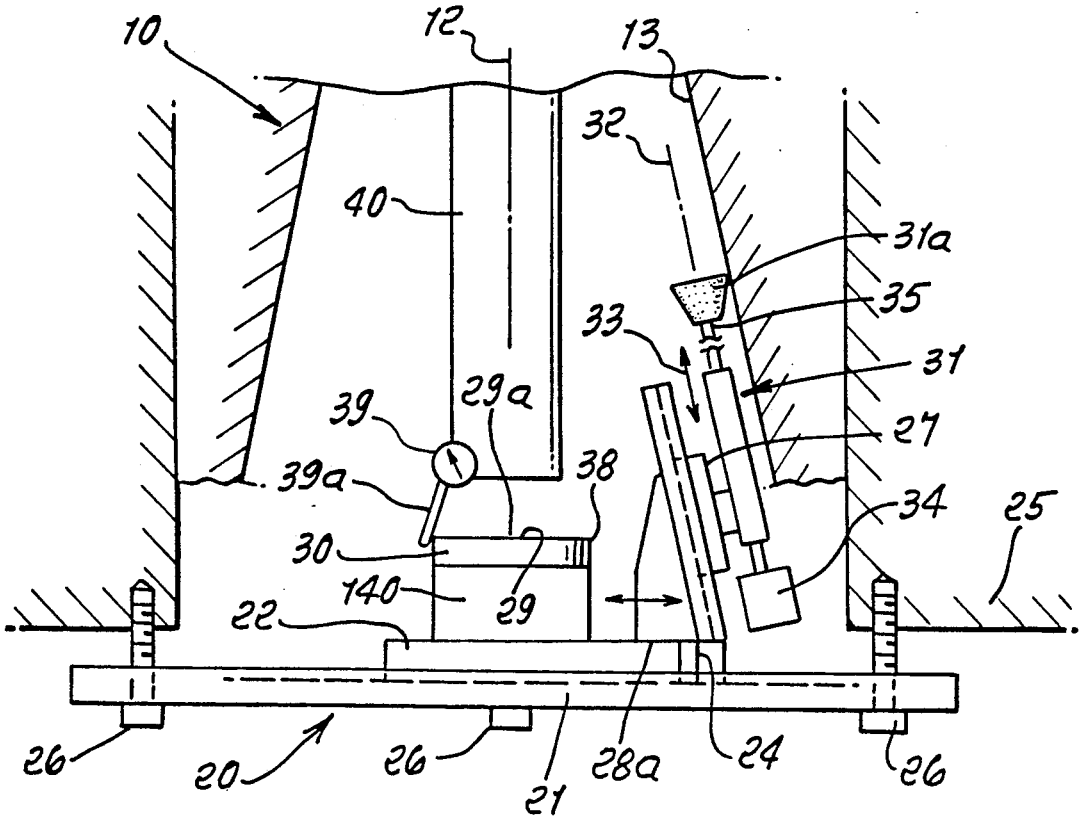
FIG. 2 is a schematic view of apparatus and method for accomplishing the in-place grinding of the spindle bore.

In accordance with the invention, and referring to FIG. 2, method and means is provided to perform grinding of the spindle without removing it from the machine tool apparatus, i.e., in-place grinding to "true-up" the bore relative to axis 12. In this regard, the method, as claimed herein, may be carried out using apparatus to be described, or other equivalent apparatus. Such apparatus includes structure, including a master plate having a surface facing the bore 13, that surface having a predetermined boundary to define a center. See for example the structure 20, which includes a bottom plate 21 supporting a bottom slide 22, slidable on the plate surface 21, in X-Y directions generally perpendicular to the Z axis direction of axis 12.

Directions X-Y-Z define a rectangular coordinate system. The slide 22 may alternatively be moved in only the X direction. Suitable means is provided for holding the slide at its adjusted position relative to plate 21, such means indicated at 24 in two positions associated with the X and Y axes, and which may include suitable clamps which are adjustable.

The bottom plate 21 may itself by adjustably attached to support structure or machine bed indicated at 25 and associated with 10, and may be adjustably tilted relatively to 25 at two 90° locations by means indicated generally at 26, as for example jack screws.

The angled slide 27 is supported by mount 28*a* rigidly mounted at 28 on the bottom slide 22, the slide 27 being movable endwise (see arrows 33) relative to is the structure 20 and at a predetermined angle $\alpha$ relative to the plane of the top surface 29 of the master plate 30. The latter is carried at 140 by the bottom elide 22. The master plate 30 is movable with the bottom slide 22, since it is rigidly carried thereby, and movable in X and Y directions with 22.

A rotary grinder 31 is carried on the angled slide 27 to be movable endwise therewith in direction 33, while the grinder head 31*a* is rotated about an axis 32 parallel to the direction of sliding movement of the slide 27. See arrows 33. A motor to rotate the head 31*a* is indicated at 34; and 35 indicates the slidable connection of the grinder head to move endwise in the direction of axis 32.

The grinder head 31*a* is operated to engage the spindle bore 13 for grinding same to true the bore as the spindle rotates and as the head rotates, whereby the bore is concentrically trued about the axis 12.

In accordance with a further aspect of the invention, the structure 20 is adjustable to bring the master plate surface 29 into perpendicularity to the axis 12, and to bring the center 29*a* of that surface into coincidence with axis 12, after which time the grinder may be operated, as described, to true the bore. The master plate 30 has a boundary extending about the plate surface 29, that boundary being employed during the adjustment of the structure 20, as referred to. Typically, the boundary indicated at 38 extends circularly about the master plate surface, and about center 29*a*, whereby a sensor, including an indicator 39, may be employed to engage the circular boundary during the adjustment of the structure 20, as referred to. The indicator is carried by a shaft 40 associated with the spindle, that shaft having an axis coincident with axis 12. During set up, the shaft carrying the indicator is rotated about axis 12, and the indicator tip 39*a* engages the circular boundary, or edge 38, of the plate 30 and surface 29.

If the indicator displays no gauge movement as shaft 40 is rotated, it means that the adjustment of the structure 20 has been such as to locate surface 29 perpendicular to axis 12 and to locate edge 38 concentrically about axis 12, and to locate center 29*a* coincident with axis 12. Such adjustment includes adjustable tilting of plate 21, and X-Y adjustment of the bottom slide 22 relative to plate 21.

Thereafter, the grinding tool may be operated, as described, to true the tapered bore 13. As referred to, the grinding tool 31 may be moved endwise in opposite directions 33, is now correctly angled relative to axis 12 for correctly truing the tapered bore about axis 12, as the grinding head is moved endwise back and forth.

After completion of grinding, the apparatus is separated from the spindle, and the latter is then in condition for mounting a rotary tool machine engaging the bore 13.

Figure 3:
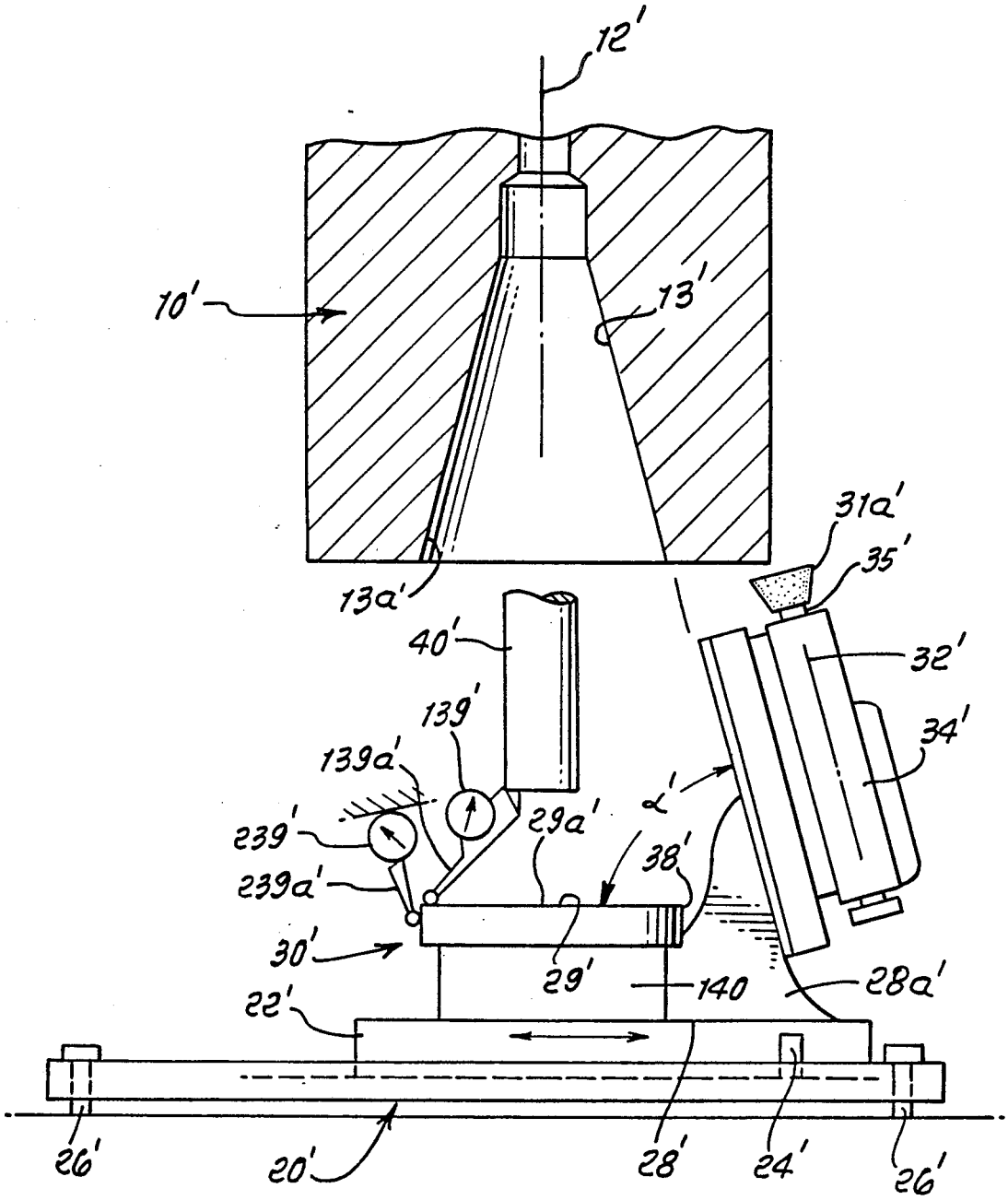
FIG. 3 is a schematic view of a somewhat modified apparatus.

Referring to FIG. 3, the modified apparatus is generally like that of FIG. 2; and corresponding identifying numerals have an appended prime designation. Two indicators, 139′ and 239′, are employed on 40′ and have tips 139′a engaging the top surface 29′ near its outer edge, and engaging the outer cylindrical surface 130′ of plate 30′. A machine bed is seen at 25′.

I claim:

1. A method of grinding the bore of a rotary spindle, said bore having a taper, to true said bore while the spindle rotates about a spindle axis, the steps that include a) providing structure including a master plate having a surface facing said bore, said surface having a predetermined boundary to define a center, b) providing an angled slide on said structure, the slide being movable endwise relative to said spindle and at a predetermined angle to said axis, said angle corresponding to the spindle bore taper, c) providing a rotary grinder on said angled slide to be movable endwise therewith while the grinder rotates, d) adjusting said structure to bring said master plate surface into perpendicularity to said axis and to bring said center into coincidence with said axis, and e) operating said grinder to grind said tapered bore as the spindle is rotated and as said angled slide is moved endwise at said predetermined angle to said structure.

2. The method of claim 1 wherein said structure includes a bottom slide to be movable generally normal to said axis, and mounting said master plate on said bottom slide to be movable therewith.

3. The method of claim 2 including providing a motor drive for said rotary grinder to rotate same, and supporting said motor drive on said bottom slide.

4. The method of claim 1 wherein said grinder includes a grinding head, and said operating said grinder includes moving said head along an angle defined by said rotating tapered bore.

* * * * *